US006543249B2

(12) United States Patent
Kim et al.

(10) Patent No.: US 6,543,249 B2
(45) Date of Patent: Apr. 8, 2003

(54) COOLING AIR SUPPLYING DEVICE IN REFRIGERATOR

(75) Inventors: Sang Bae Kim, Changwon (KR); Young Seok Choi, Changwon (KR); Byung Gyu Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/036,375

(22) Filed: Jan. 7, 2002

(65) Prior Publication Data

US 2003/0037565 A1 Feb. 27, 2003

(30) Foreign Application Priority Data

| | | |
|---|---|---|
| Aug. 21, 2001 | (KR) | 2001-50465 |
| Aug. 21, 2001 | (KR) | 2001-50466 |
| Aug. 21, 2001 | (KR) | 2001-50468 |
| Aug. 31, 2001 | (KR) | 2001-53401 |
| Sep. 1, 2001 | (KR) | 2001-53728 |

(51) Int. Cl.[7] ..... F25D 17/08
(52) U.S. Cl. ..... 62/407
(58) Field of Search ..... 62/337, 407, 404, 62/441

(56) References Cited

U.S. PATENT DOCUMENTS

| | | | | |
|---|---|---|---|---|
| 5,729,997 A | * | 3/1998 | Witsoe | 62/407 |
| 5,799,500 A | * | 9/1998 | Kang | 62/408 |
| 5,960,641 A | * | 10/1999 | Kim et al. | 62/407 |
| 6,062,037 A | * | 5/2000 | Yoon | 62/407 |
| 6,094,931 A | * | 8/2000 | Jeong | 62/407 |
| 6,347,530 B1 | * | 2/2002 | Kim | 62/407 |
| 6,381,982 B1 | * | 5/2002 | Kim | 62/407 |

* cited by examiner

*Primary Examiner*—Henry Bennett
*Assistant Examiner*—Malik N. Drake
(74) *Attorney, Agent, or Firm*—Fleshner & Kim, LLP

(57) ABSTRACT

A cooling air supplying device of a refrigerator is provided. According to the cooling air supplying device, it is possible to supply cooling air to the respective cells divided by shelves of a chilling chamber, to thus impartially supply the cooling air to the chilling chamber. Accordingly, it is possible to uniformly maintain the spread of temperature of the chilling chamber. The cooling air supplying device of the refrigerator includes a cooling air supply path formed in the upper portion of a mullion wall for separating a freezing chamber from the chilling chamber, the cooling air supply path for supplying the cooling air blown from a blast fan arranged in the freezing chamber to the chilling chamber, a discharge duct connected to the cooling air supply path and installed in the upper portion of the chilling chamber, the discharge duct for discharging the cooling air from the upper portion of the chilling chamber, cooling air guide channels connected to the discharge duct, the cooling air guide channels for guiding the cooling air to one side or both sides of the chilling chamber, and cooling air discharge units connected to the cooling air guide channels and formed on one side surface or the both side surfaces of a main frame, the cooling air discharge units for discharging the cooling air from the side surface of the chilling chamber into the respective cells divided by the shelves.

21 Claims, 14 Drawing Sheets

COOLING AIR SUPPLYING DEVICE IN REFRIGERATOR

BACKGROUND OF THE INVENTION

1. Field of the Invention

The present invention relates to a cooling air supplying device in a refrigerator, and more particularly, to a cooling air supplying device in a refrigerator, which is capable of impartially and rapidly supplying cooling air to a chilling chamber.

2. Description of the Background Art

In general, a refrigerator is divided into a freezing chamber for keeping an ice making container and frozen food and a chilling chamber for keeping cold food. The refrigerator includes a freezing cycle for supplying cooling air to the freezing chamber and the chilling chamber.

A common type refrigerator, where the freezing chamber and the chilling chamber are arranged in a vertical direction, and a side-by-side type refrigerator having a large capacity, where the freezing chamber and the chilling chamber are arranged in a horizontal direction, are mainly used.

FIG. 1 is a perspective view showing a partially sectioned side-by-side type refrigerator according to a conventional technology. FIG. 2 is a sectional view taken along the line A—A.

A conventional refrigerator includes a main frame 204, in which a pair of doors 202 bi-directionally opened and closed are installed in the front portion and a receipt space is included, a freezing chamber 206 arranged on either the left side or the right side of the main frame 204, the freezing chamber 106 for keeping frozen food, a chilling chamber 208 separated from the chilling chamber 206 by a mullion wall 210 and arranged on the other side of the main frame 204, the chilling chamber 208 for keeping cold food, a freezing chamber cooling air supplying device installed in the upper portion of the freezing chamber 206, the freezing chamber cooling air supplying device for supplying the air cooled while passing through the freezing cycle (not shown) to the freezing chamber 106, and a chilling chamber cooling air supplying device connected to the freezing chamber cooling air supplying device, the chilling chamber cooling air supplying device for supplying the cooling air to the chilling chamber 208.

A plurality of shelves 212 and 214 are installed in the freezing chamber 206 and the chilling chamber 208 to be separated from each other by a predetermined distance so that food can be kept by layers. Vegetable boxes 216 and 218 for keeping vegetables are bedded in the lower portion of the shelves 212 and 214.

The freezing cooling air supplying device includes a blast fan 220 installed on the hind surface in the upper portion of the freezing chamber 206, the freezing chamber cooling air supplying device for forcibly bowing the air cooled whiled passing through the freezing cycle, a first panel 226 arranged in front of the blast fan 220 and having a plurality of discharge openings 224 so that the cooling air blown by the blast fan 220 is discharged into an ice maker 222, and a second panel 228 arranged below the blast fan 220 and having a plurality of discharge openings 230 so that the cooling air is discharged into the freezing chamber 206.

The chilling chamber cooling air supplying device includes a cooling air supply path 232 formed in the upper portion of the mullion wall 210 so as to discharge the cooling air blown from the blast fan 220 installed in the freezing chamber 206 into the chilling chamber 208, a cooling air discharge duct 234 installed in the upper portion of the chilling chamber 208 and connected to the cooling air supply path 232, the cooling air discharge duct 234 for discharging the cooling air supplied to the cooling air supply path 232 into the chilling chamber 208, and a cooling air suction path 238 formed in the lower portion of the mullion wall 210, the cooling air suction path 238 for sucking up the cooling air that completed a cooling operation while circulating in the chilling chamber 208 into the freezing cycle.

The cooling air discharge duct 234 is horizontally arranged in the upper portion of the chilling chamber 208. One side of the cooling air discharge duct 234 is opened to be connected to the cooling air supply path 232. A plurality of cooling air discharge openings 236 for discharging the cooling air into the chilling chamber 208 are formed in the front portion of the cooling air discharge duct 234.

According to the conventional side-by-side type refrigerator having the above structure, when the freezing cycle is driven and the blast fan 220 is rotated, the air cooled while passing through the freezing cycle is discharged into the discharge openings 224 of the first panel, the discharge openings 230 of the second panel, and the cooling air supply path 232 by the blast pressure of the blast fan 220.

The cooling air discharged into the discharge openings 224 of the first panel is supplied to the ice maker 222, to thus make ice. The air discharged into the discharge openings 230 of the second panel freezes the frozen food stored in the freezing chamber 206 while circulating the freezing chamber 206.

The cooling air supplied to the cooling air supply path 232 is sucked up into the cooling air discharge duct 234 and is discharged into the chilling chamber 208 through the cooling air discharge openings 236 formed in the cooling air discharge duct 234. The cooling air discharged into the chilling chamber 208 cools the cold food kept in the chilling chamber 208 while circulating in the chilling chamber 208. The cooling air that completed the cooling operation is sucked up into a cooling cycle through the cooling air suction path 238 formed in the lower portion of the mullion wall 210 and is cooled again while passing through the cooling cycle.

However, according to the chilling chamber cooling air supplying device of the above conventional refrigerator, the cooling air is discharged only through the discharge openings 236 formed in the cooling air discharge duct since the cooling air discharge duct 234 is horizontally arranged in the upper portion of the chilling chamber 208. Therefore, the food stored in the upper portion of the chilling chamber 208 is excessively cooled since the food is significantly affected by the cooling air. The food stored in the lower portion of the chilling chamber 208 is weakly cooled since the food is less affected by the cooling air.

That is, the deviation of temperature of the cooling air supplied from the upper portion of the chilling chamber to the lower portion of the chilling chamber becomes more significant and the temperatures of the respective cells divided by the shelves are different from each other according to the distances from the cooling air discharge openings. Accordingly, the spread of temperature of the chilling chamber is not uniform.

Also, since the cooling air is supplied from the upper portion of the chilling chamber to the lower portion of the chilling chamber, the cooling air cannot smoothly circulate in the chilling chamber due to the shelves for separating the respective cells from each other.

Also, since the cooling air is discharged from only the upper portion of the chilling chamber, it takes longer to cool the entire chilling chamber. Accordingly, the freshness of the food stored in the chilling chamber deteriorates.

Also, it is difficult to rapidly cope with a rise in temperature of the chilling chamber, which is caused by frequently opening and closing the door of the chilling chamber in summer.

SUMMARY OF THE INVENTION

Therefore, an object of the present invention is to provide a cooling air supplying device of a refrigerator, which is capable of impartially supplying cooling air to the respective cells divided by the shelves of a chilling chamber, to thus make the spread of temperature of the chilling chamber uniform.

Another object of the present invention is to provide a cooling air supplying device of a refrigerator, which is capable of letting the cooling air discharged from around the door of the chilling chamber, to thus prevent a rise in temperature of the chilling chamber, which is caused by frequently opening and closing the door of the chilling chamber, and to thus prevent a drop in temperature of the food stored near the door.

Another object of the present invention is to provide a cooling air supplying device of a chilling chamber, which is capable of letting the cooling air discharged from predetermined protrusions on both side surfaces of the chilling chamber, to thus prevent the cooling air from leaking out of an opening between the chilling chamber and a door gasket.

Another object of the present invention is to provide a cooling air supplying device of a refrigerator, which is capable of letting the cooling air discharged into a vegetable chamber, in which the vegetable boxes of the chilling chamber are bedded, to thus smoothly cool the vegetable chamber.

Another object of the present invention is to provide a cooling air supplying device of a refrigerator, which is capable of providing blast pressure to the cooling air discharged into the chilling chamber, to thus rapidly cool the chilling chamber and to thus reduce time corresponding to the load of the chilling chamber.

To achieve these and other advantages and in accordance with the purposes of the present invention, as embodied and broadly described herein, there is provided a cooling air supplying device of a refrigerator, comprising a cooling air supply path formed in the upper portion of a mullion wall for separating a freezing chamber from a chilling chamber, the cooling air supply path for supplying cooling air blown from a blast fan arranged in the freezing chamber to the chilling chamber, a discharge duct connected to the cooling air supply path and installed in the upper portion of the chilling chamber, the discharge duct for discharging the cooling air from the upper portion of the chilling chamber, cooling air guide channels connected to the discharge duct, the cooling air guide channels for guiding the cooling air to one side or both sides of the chilling chamber, and cooling air discharge units connected to the cooling air guide channels and formed on one side surface or the both side surfaces of a main frame, the cooling air discharge units for discharging the cooling air from the side surface of the chilling chamber into the respective cells divided by shelves.

The discharge duct is horizontally attached to the hind wall in the upper portion of the chilling chamber and has a plurality of discharge openings for discharging the cooling air into the upper portion of the chilling chamber in the front portion.

The cooling air guide channels comprise a first cooling air guide channel connected to the lower portion of the discharge duct and vertically formed in the hind portion of the chilling chamber and a second cooling air guide channels formed to extend from the first cooling air guide channel to the both side walls of the chilling chamber.

The second cooling air guide channels are formed to extend from the first cooling air guide channel to the respective cells to be separated from each other by a predetermined distance, to thus guide the cooling air to the respective cells divided by the shelves of the chilling chamber.

The cooling air discharge units comprise left discharge ducts connected to the guide channels extending to the left side among the second cooling air guide channels, the left discharge ducts for discharging the cooling air from the left side of the chilling chamber and right discharge ducts connected to the guide channels extending to the right side among the second cooling air guide channels, the right discharge ducts for discharging the cooling air from the right side of the chilling chamber.

The left and right discharge ducts are formed in the respective cells on the left and right sides of the chilling chamber and cooling air discharge openings for discharging the cooling air are formed in the front portion of the left and right discharge ducts to protrude by a predetermined width to the inside of the chilling chamber on the left and right sides of the chilling chamber.

The left and right discharge ducts are formed on the both side walls near the door of the refrigerator.

The left and right discharge ducts are formed to protrude above the portion where a door gasket attached to the door of the chilling chamber contacts the opened surface of the chilling chamber by a predetermined width.

The cooling air discharge units comprise the cooling air discharge ducts connected to the cooling air guide channels extending to the side direction of the chilling chamber and vertically loaded on the side surface of the chilling chamber and the plurality of cooling air discharge openings formed in the front portion of the cooling air discharge ducts to be separated from each other by a predetermined distance, the cooling air discharge openings for discharging the cooling air into the respective cells divided by the shelves.

The cooling air discharge ducts comprise a left discharge duct connected to the cooling air guide channels extending to the left side of the chilling chamber and vertically installed on the left side surface of the chilling chamber near the door and a right discharge duct connected to the cooling air guide channels extending to the right side of the chilling chamber and vertically installed on the right side surface of the chilling chamber near the door.

Each one side of the cooling air discharge ducts is formed to protrude by a predetermined width to the inside of the chilling chamber so that each one side of the cooling air discharge ducts contacts the door gasket attached to the door for opening and closing the chilling chamber.

A cooling air supplying device of a refrigerator according to the present invention includes a cooling air supply path formed in the upper portion of a mullion wall for separating a freezing chamber from a chilling chamber, the cooling air supply path for supplying cooling air blown from a blast fan installed in the freezing chamber to the chilling chamber, a cooling air guide duct connected to the cooling air supply path and installed in the upper portion of the chilling chamber, the cooling air guide duct for guiding the cooling air supplied to the cooling air supply path to one side wall or both side walls of the left and right side walls of the chilling chamber, and discharge ducts connected to the cooling air guide duct and loaded on one surface or the both surfaces of the left and right sides of the chilling chamber, the discharge ducts for discharging the cooling air guided by the cooling air guide duct into the respective cells of the chilling chamber.

The cooling air guide duct is horizontally loaded on the hind wall in the upper portion of the chilling chamber, one side of the cooling air guide duct is connected to the cooling air supply path, and left and right guide paths for supplying the cooling air to the left and right sides of the chilling chamber are formed on the left and right sides in the front portion.

The discharge ducts comprise a left discharge duct connected to the left guide path of the cooling air guide duct, formed on the left side wall of the chilling chamber to protrude to the inside of the chilling chamber, and having a plurality of left discharge openings for discharging the cooling air into the respective cells divided by the shelves in the front portion and a right discharge duct connected to the right guide path of the cooling air guide duct, formed on the right side wall of the chilling chamber to protrude to the inside of the chilling chamber, having a plurality of right discharge openings for discharging the cooling air into the respective cells divided by the shelves in the front portion.

The left and right discharge ducts are attached on the left and right side walls of the chilling chamber to occupy wide areas and each one side surface tilts to have a predetermined tilt angle so as to contact the door gasket loaded in the door.

The left and right discharge openings are formed in the front portion of the left and right discharge ducts to be separated from each other by a predetermined distance so that the cooling air is discharged into the respective cells divided by the shelves and are horizontally arranged in two row.

A cooling air supplying device of a refrigerator according to the present invention includes a cooling air supply path formed in the upper portion of a mullion wall for separating a freezing chamber from a chilling chamber, the cooling air supply path for supplying cooling air blown from a blast fan installed in the freezing chamber to the chilling chamber, a cooling air guide duct connected to cooling air supply path and installed in the upper portion of the chilling chamber, the cooling air guide duct for guiding the cooling air supplied to the cooling air supply path to one side wall or both side walls of the left and right side walls of the chilling chamber, and a cooling air discharge duct connected to the cooling air guide duct and loaded on one side surface or on the both side surfaces of the left and right sides of the chilling chamber, the cooling air discharge duct for discharging the cooling air from the side surface of the chilling chamber into the respective cells and discharging the cooling air into the vegetable chambers, in which vegetable boxes are bedded.

The cooling air discharge duct is formed near the door so that the cooling air is discharged from the door into the chamber, a plurality of discharge openings for discharging the cooling air into the respective cells divided by the shelves are formed in the front portion to be separated from each other by a predetermined distance, and the cooling air discharge duct is formed to extend to the vegetable chambers of the chilling chamber so as to discharge the cooling air into the vegetable chambers.

Cooling air discharge openings for discharging the cooling air into the vegetable chambers are formed in the portion extended to the vegetable chambers of the cooling air discharge duct.

The vegetable storage boxes are bedded in the vegetable chambers to be separated from the both side walls and the hind wall of the chilling chamber by predetermined distances so that the cooling air discharged through the discharge openings can smoothly circulate around the vegetable storage boxes.

A cooling air supplying device of a refrigerator according to the present invention includes a cooling air supply path formed in the upper portion of a mullion wall for separating a freezing chamber from a chilling chamber, the cooling air supply path for supplying cooling air blown from a blast fan installed in the freezing chamber to the chilling chamber, a discharge duct 34 connected to the cooling air supply path 32 and installed in the upper portion of the chilling chamber, the discharge duct for discharging the cooling air from the chilling chamber, cooling air guide channels connected to the discharge duct 34, the cooling air guide channels for guiding the cooling air to one side surface or both side surfaces of the chilling chamber, cooling air discharge units connected to the cooling air guide channels and formed, one surface or both surfaces of a main frame, the cooling air discharge units for discharging the cooling air into the respective cells divided by the shelves on the side surface of the chilling chamber, and a pressure fan installed in the discharge duct, the pressure fan for providing blast pressure to the cooling air discharged into the chilling chamber.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An embodiment of a cooling air supplying device of a refrigerator according to the present invention will now be described with reference to the attached drawings.

A plurality of embodiments of the cooling air supplying device of the refrigerator according to the present invention can exist. However, a preferred embodiment will now be described.

Figure 1:
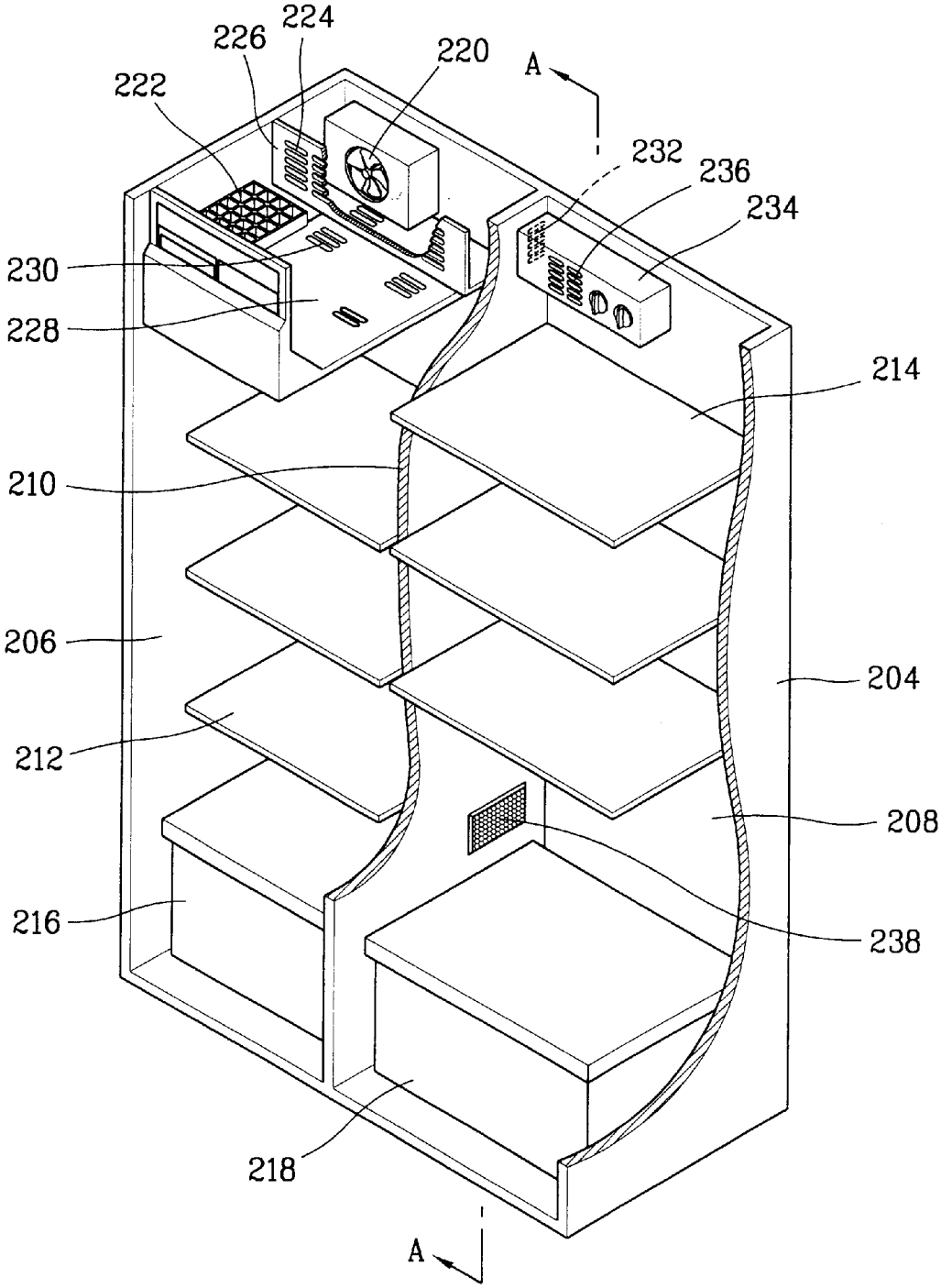
FIG. 1 BACKGROUND ART
FIG. 1 is a perspective view showing a partially sectioned refrigerator according to a conventional technology.
Figure 2:
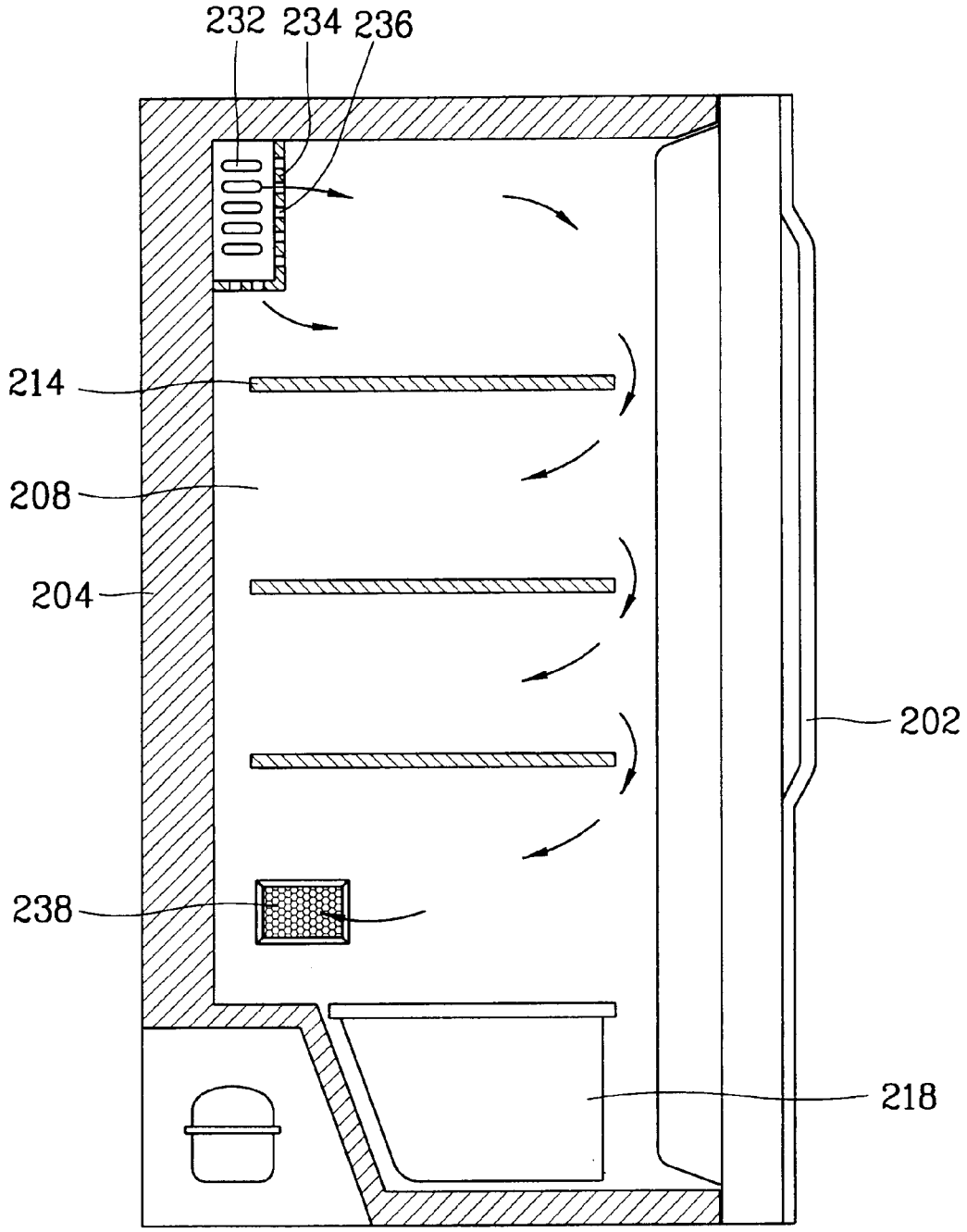
FIG. 2 BACKGROUND ART
FIG. 2 is a sectional view taken along the line A—A showing a chilling chamber cooling air supplying device of a refrigerator according to the conventional technology.
Figure 3:
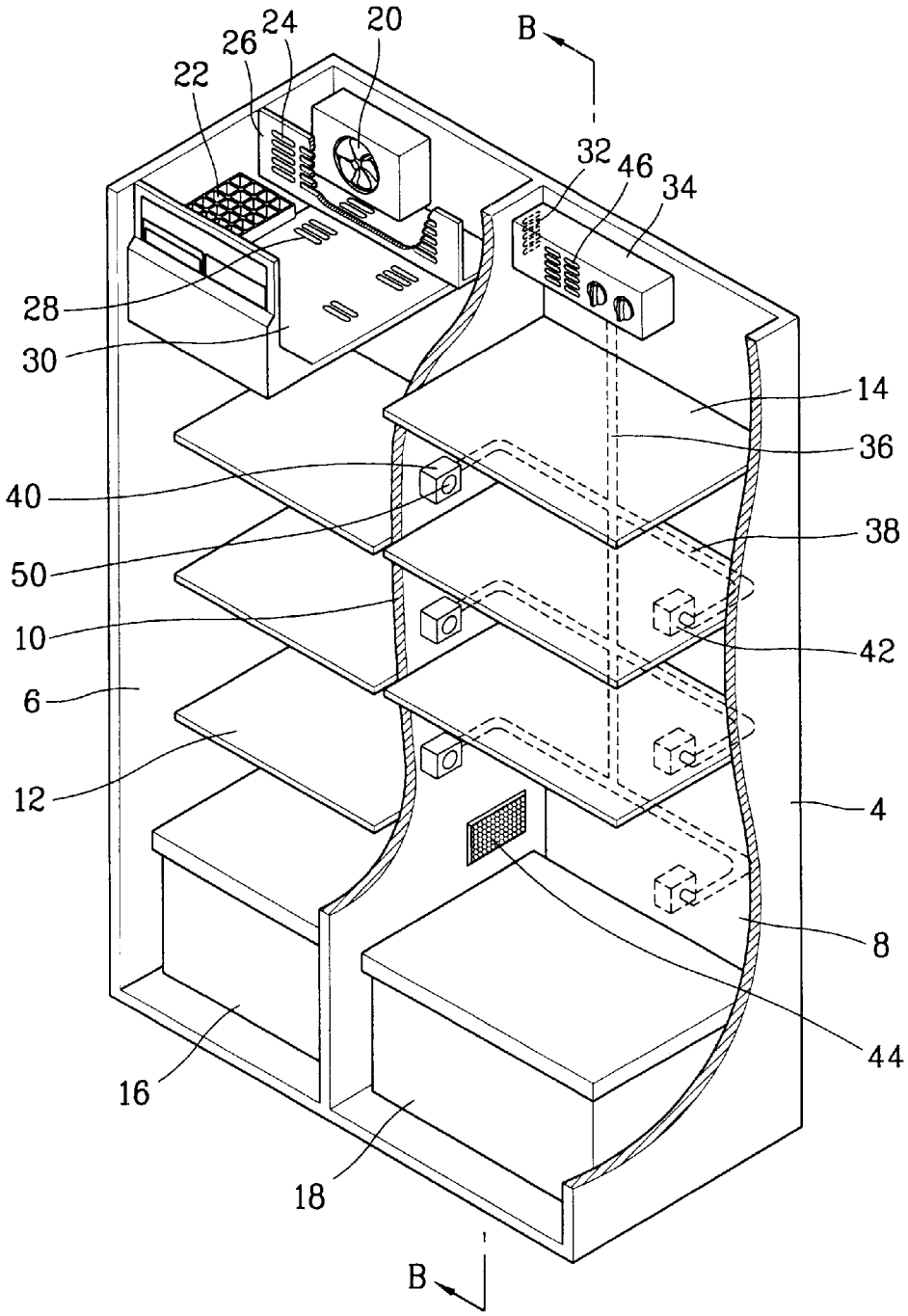
FIG. 3 is a perspective view of a partially sectioned refrigerator according to the present invention.
Figure 4:
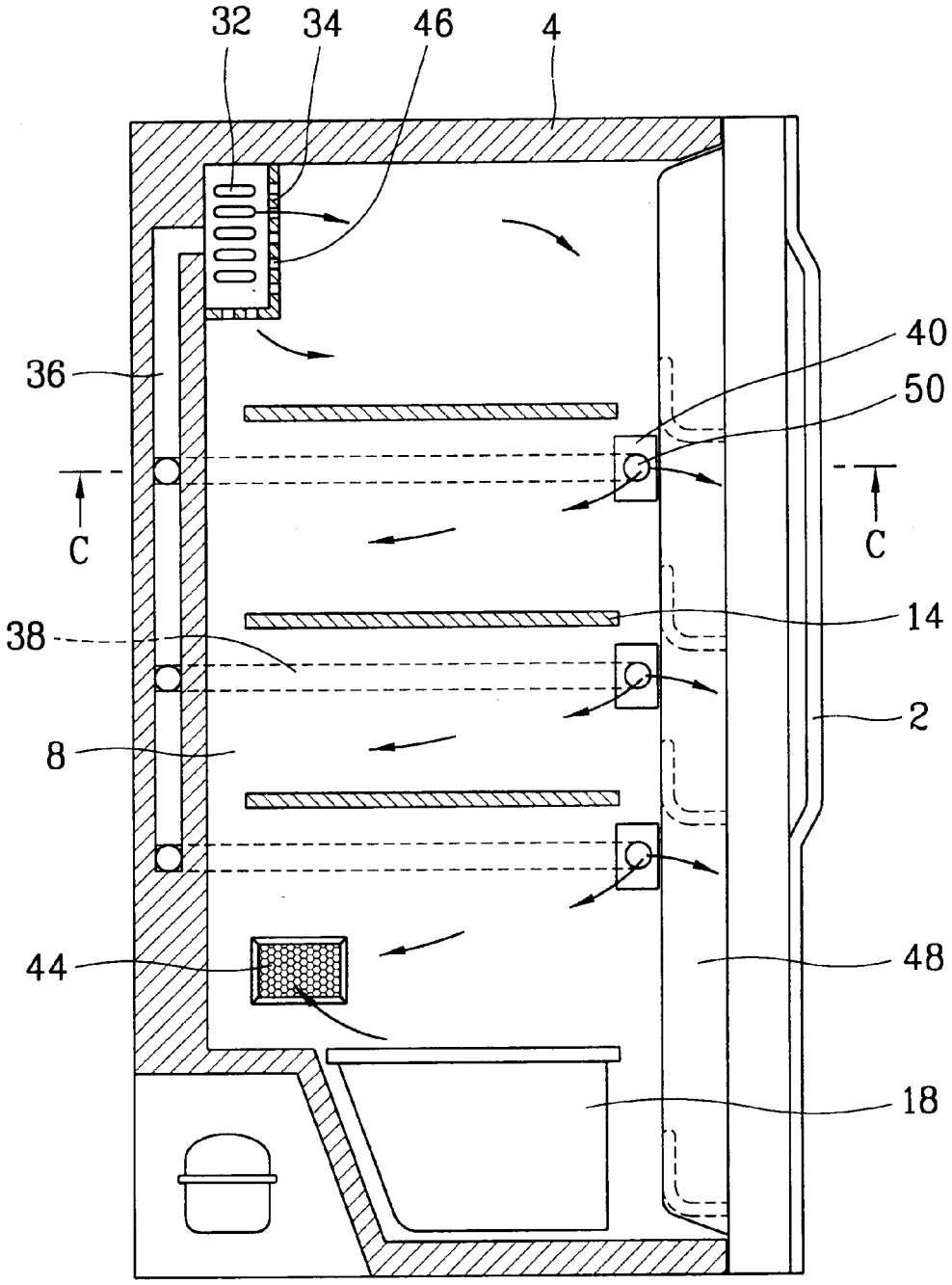
FIG. 4 is a sectional view taken along the line B—B of FIG. 3 showing a chilling chamber cooling air supplying device of a refrigerator according to the present invention.

FIG. 3 is a perspective view showing a partially sectioned refrigerator according to the present invention. FIG. 4 is a sectional view taken along the line B—B of FIG. 3 showing a cooling air supplying device of a refrigerator according to the present invention.

A refrigerator according to the present invention includes a main frame 4, in which a door 2 bi-directionally opened and closed is installed on an opened front side and which has a receipt space for storing food, a freezing chamber 6 formed on either the left side or the right side of the main frame 4, the freezing chamber 6 for storing frozen food, a chilling chamber 8 separated from the freezing chamber 6 by a mullion wall 10 and formed on the opposite side of the freezing chamber 6, a freezing cycle (not shown) installed on one side of the main frame 4, the freezing cycle for generating cooling air, a freezing chamber cooling air supplying device for supplying the air cooled while passing through the freezing cycle to the freezing chamber 6, and a chilling chamber cooling air supplying device for supplying the air cooled while passing through the freezing cycle to the chilling chamber 8.

Shelves 12 and 14, in which food is bedded, are vertically installed in the freezing chamber 6 and the chilling chamber 8 to be separated from each other by a predetermined distance. Vegetable boxes 16 and 18 for storing vegetables are bedded in the lower portion of the freezing chamber 6 and the chilling chamber 8.

The freezing chamber cooling air supplying device includes a blast fan 20 attached to the hind surface in the upper portion of the freezing chamber 6, the blast fan 20 for forcibly circulating the air cooled while passing through the freezing cycle, a first panel 26 installed in front of the blast fan 20 and having discharge openings 24 for discharging the cooling air blown from the blast fan 20 into an ice maker 22, and a second panel 30 installed below the blast fan 20 and having discharge openings 28 for discharging the cooling air blown from the blast fan 20 into the freezing chamber 6.

Figure 5:
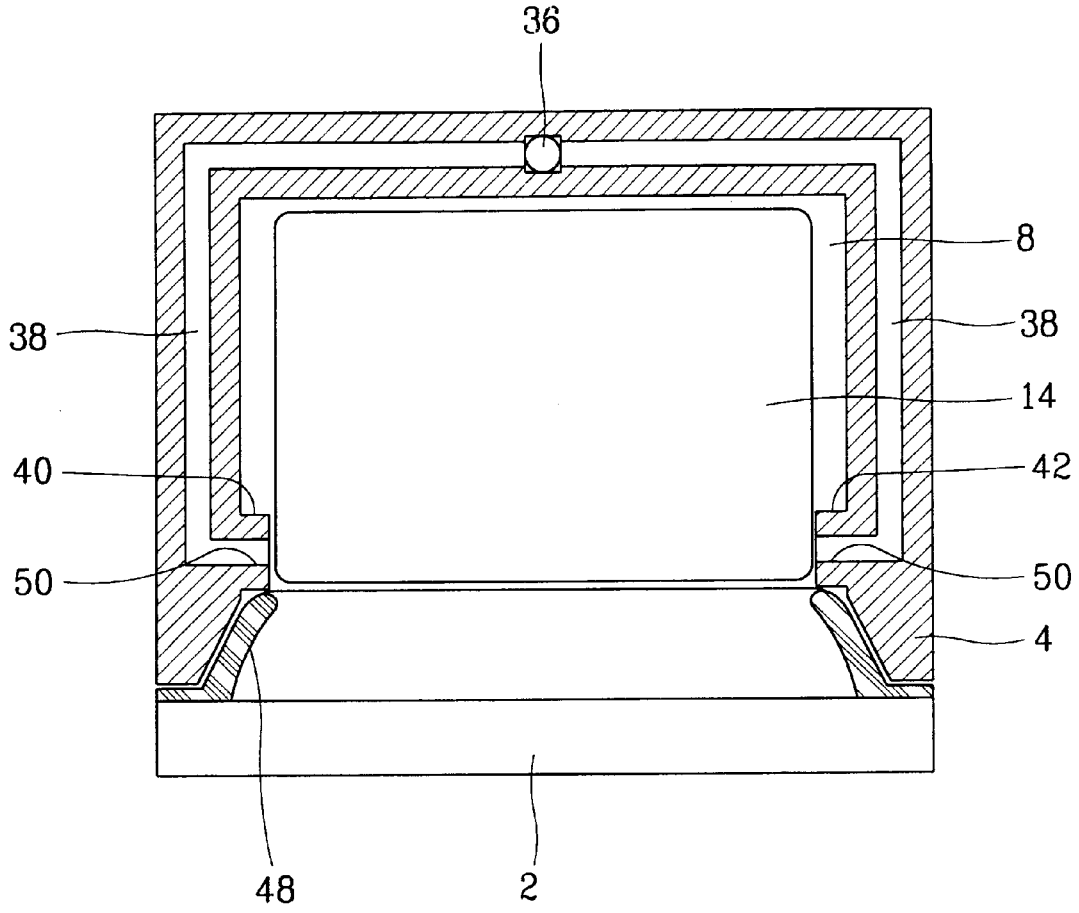
FIG. 5 is a sectional view taken along the line C—C of FIG. 4 showing the chilling chamber cooling air supplying device of the refrigerator according to the present invention.

As shown in FIGS. 4 and 5, the chilling chamber cooling air supplying device according to an embodiment of the present invention includes a cooling air supply path 32 formed in the upper portion of the mullion wall 10, the cooling air supply path 32 for supplying the cooling air blown by the blast fan 20 to the chilling chamber 8, a discharge duct 34 connected to the cooling air supply path 32 and installed in the upper portion of the chilling chamber 8, the discharge duct 34 for discharging the cooling air from the upper portion of the chilling chamber 8, cooling air guide channels 36 and 38 connected to the discharge duct 34, the cooling air guide channels 36 and 38 for guiding the cooling air to both side surfaces of the main frame 4, and cooling air discharge units connected to the cooling air guide channels 36 and 38 and loaded in the side surface of the main frame 4 to be separated from each other by a predetermined distance, the cooling air discharge units for discharging the cooling air from the side surface of the chilling chamber 8.

A cooling air suction path 44 for sucking up the cooling air, which is discharged from the discharge duct 34 and the side surface discharge ducts 40 and 42 and completed the cooling operation while circulating the chilling chamber, into the freezing cycle is formed in the lower portion of the mullion wall 10.

The discharge duct 34 is horizontally attached on the hind wall in the upper portion of the chilling chamber 8. A plurality of discharge openings 46 for discharging the cooling air into the upper portion of the chilling chamber 8 are formed in the front portion of the discharge duct 34. One side surface of the discharge duct 34 is opened to be connected to the cooling air supply path 32. The cooling air guide channels 36 and 38 are connected to the lower portion of the discharge duct 34.

The cooling air guide channels 36 and 38 consists of the first cooling air guide channel 36 connected to the lower portion of the discharge duct 34 and vertically formed in the hind portion of the chilling chamber and a plurality of second cooling air guide channels 38 formed to extend from the first cooling air guide channel 36 to the both side walls of the chilling chamber, the second cooling air guide channels 38 for guiding the cooling air to the respective cells divided by the shelves 14.

The cooling air discharge units include a plurality of left discharge ducts 40 connected to the second cooling air guide channels 38 that extend from the first cooling air guide channel 36 to the left side and installed near the door 2 on the left side wall of the chilling chamber 8, the left discharge ducts 40 for discharging the cooling air guided by the cooling air guide channels 36 and 38 from the left side into the respective cells in the front portion and a plurality of right discharge ducts 42 connected to the second cooling air guide channels 38 that extend to the right wall of the chilling chamber 8 and installed near the door 2 of the right wall of the chilling chamber 8, the right discharge duct 42 for discharging the cooling air guided by the cooling air guide channels 36 and 38 from the right side of the chilling chamber 8 into the respective cells in the front portion.

The left discharge ducts 40 and the right discharge ducts 42 are formed to protrude by a predetermined width from the left and right walls of the chilling chamber to the inside of the chilling chamber. Discharge openings 50 for discharging the cooling air are formed in the protruding front portions. The left and right discharge ducts 40 and 42 are preferably loaded in the inside of the left and right walls of the chilling chamber 8 by the thickness of a door gasket 48 so as not to prevent the cooling air from being discharged when the door 2 is closed.

The operation of a cooling air supplying device of a refrigerator according to an embodiment of the present invention will now be described.

When power is applied to the refrigerator, the freezing cycle is operated and the blast fan 20 is driven. The air cooled while passing through the freezing cycle is supplied to the freezing chamber 6 and the chilling chamber 8, to thus perform the cooling operation. The air that completed the cooling operation is sucked up into the freezing cycle. The above processes are repeated.

The cooling air blown by the blast fan 20 is discharged into the discharge openings 24 of the first panel, the discharge openings 28 of the second panel, and the cooling air supply path 32.

The cooling air discharged into the discharge openings 24 of the first panel is supplied to the ice maker 22, to thus make ice. The cooling air discharged into the discharge openings 28 of the second panel is supplied to the freezing chamber 6, to thus cool the food stored in the freezing chamber while circulating the freezing chamber 6.

The cooling air discharged from the blast fan 20 and sucked up into the cooling air supply path 32 is supplied to the discharge duct 34 and cools the food stored in the upper portion of the chilling chamber 8 through the discharge openings 46 formed in the front portion of the discharge duct 34.

The cooling air supplied to the discharge duct 34 is guided to the left and right sides of the chilling chamber 8 along the first cooling air guide channel 36 and the second cooling air guide channels 38 and is discharged into the respective cells of the chilling chamber 8 divided by the shelves 14 through the discharge openings 50 formed in the left and right discharge ducts 40 and 42, to thus cool the food stored in the respective cells.

That is, the cooling air guided to the left side of the chilling chamber 8 by the second cooling air guide channels 38 is discharged from the left side of the chilling chamber 8 into the respective cells through the discharge openings 50 formed in the left discharge ducts 40. The cooling air guided to the right side of the chilling chamber 8 by the second cooling air guide channels 38 is discharged from the left side of the chilling chamber 8 into the respective cells through the discharge openings 50 formed in the right discharge ducts 42.

The cooling air discharged from the discharge duct 34 cools the food stored in the upper portion of the chilling chamber 8 and is sucked up into the freezing cycle through the cooling air suction path 44 formed in the lower portion of the mullion wall 10. The cooling air discharged from the left and right discharge ducts 40 and 42 is discharged into the respective cells, to thus cool the food stored in the respective cells, and is sucked up into the freezing cycle through the cooling air suction path 44 formed in the lower portion of the mullion wall 10.

In the cooling air supplying device of the chilling chamber according to the embodiment, since the cooling air is discharged from a position near the door into the respective cells, the cooling air can impartially circulate in the chilling chamber. Speed, at which the chilling chamber is cooled, increases. Also, it is possible to prevent a drop in temperature, which is caused by frequently opening and closing the door.

Figure 6:
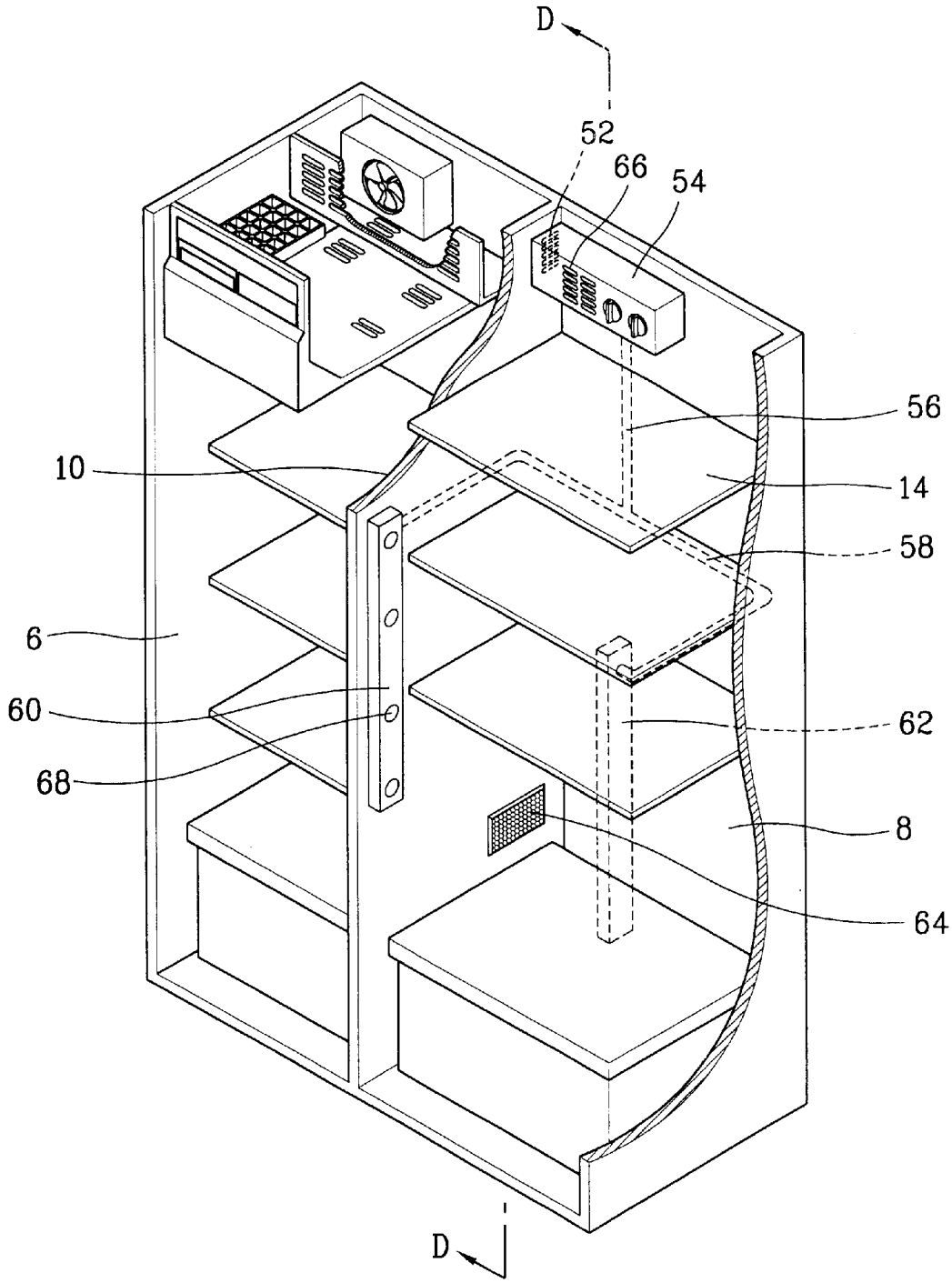
FIG. 6 is a perspective view showing a chilling chamber cooling air supplying device of a refrigerator according to a second embodiment of the present invention.
Figure 7:
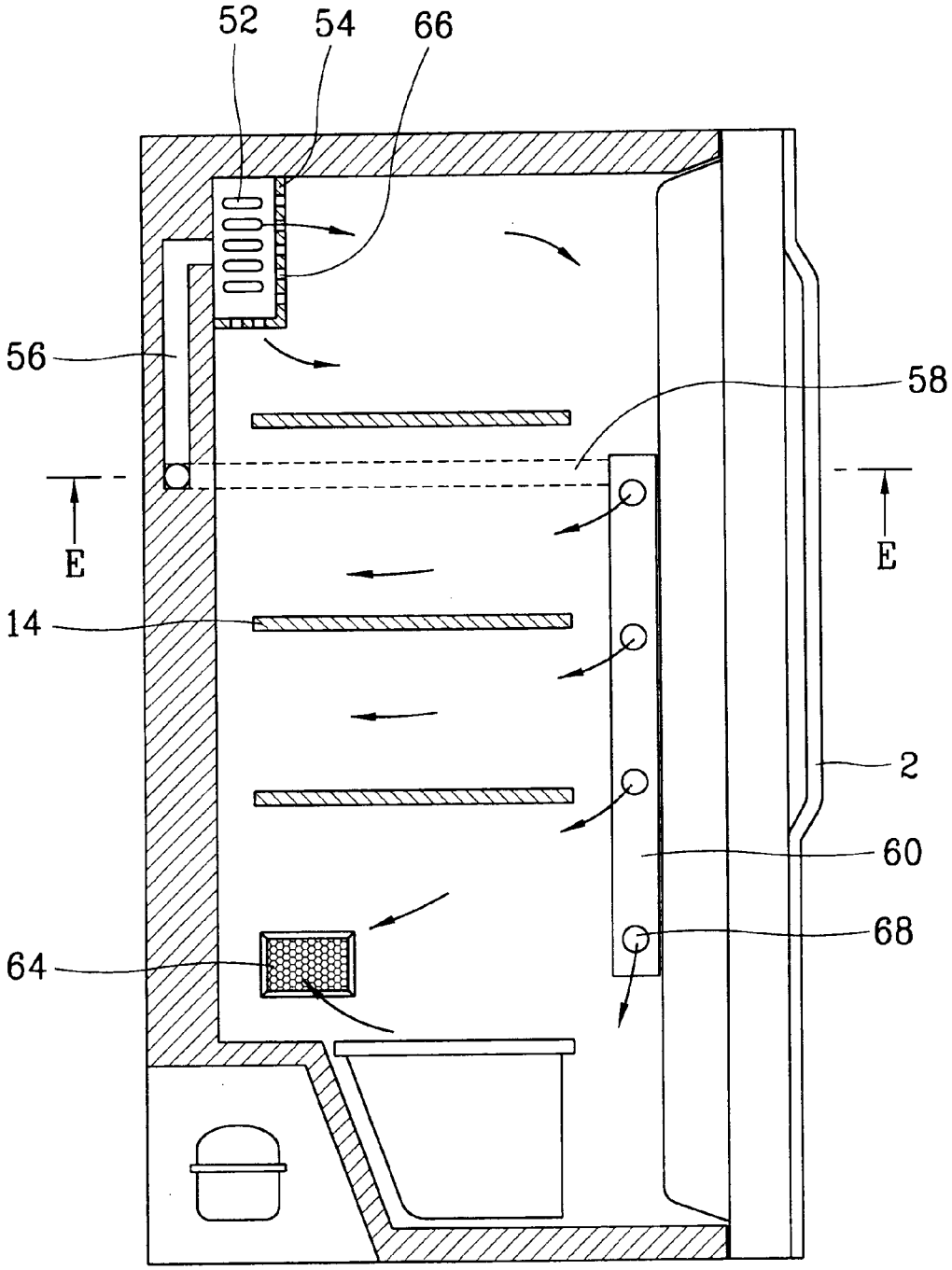
FIG. 7 is a sectional view taken along the line D—D of Figure showing the chilling chamber cooling air supplying device of the refrigerator according to the second embodiment of the present invention.
Figure 8:
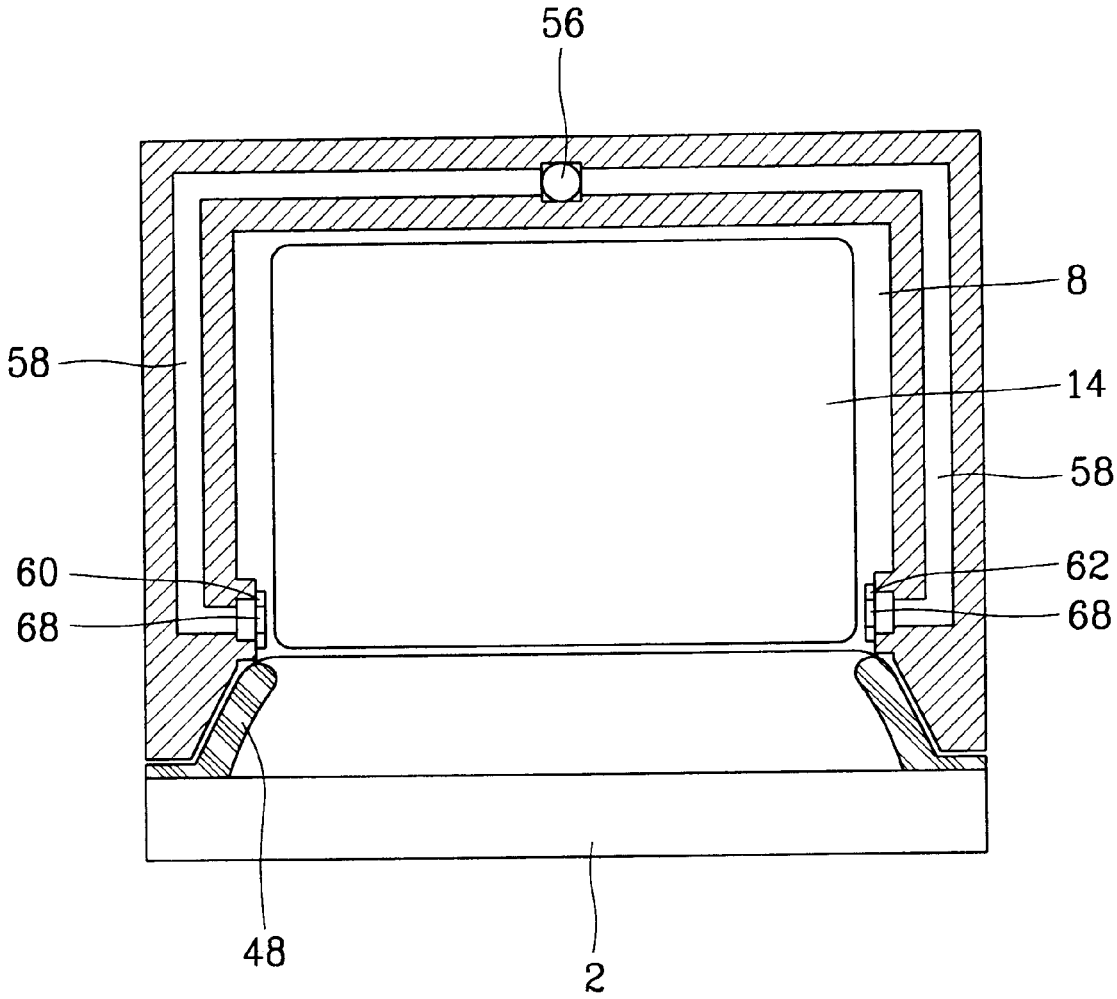
FIG. 8 is a sectional view taken along the line E—E of FIG. 7 showing the chilling chamber cooling air supplying device of the refrigerator according to the second embodiment of the present invention.

FIG. 6 is a perspective view of a partially sectioned refrigerator according to a second embodiment of the present invention. FIG. 7 is a sectional view taken along the line D—D of FIG. 6 showing a cooling air supplying device of a refrigerator according to the second embodiment of the present invention. FIG. 8 is a sectional view taken along the line E—E of FIG. 7 showing the cooling air supplying device of the refrigerator according to the second embodiment.

The chilling chamber cooling air supplying device of the refrigerator according to the second embodiment has the same structure as the structure of the above-mentioned chilling chamber cooling air supplying device of the embodiment.

The chilling chamber cooling air supplying device according to the second embodiment includes a cooling air supply path 52 formed in the upper portion of the mullion wall 10 for separating the freezing chamber 6 from the chilling chamber 8, the cooling air supply path 52 for supplying the cooling air-blown from the blast fan 20 installed in the freezing chamber 6 to the chilling chamber 8, a discharge duct 54 connected to the cooling air supply path 52 and horizontally installed in the upper portion of the chilling chamber 8, the discharge duct 54 for discharging the cooling air into the upper portion of the chilling chamber 8, cooling air guide channels 56 and 58 connected to the discharge duct 54, the cooling air guide channels 56 and 58 for guiding the cooling air to the both side walls of the chilling chamber 8, left and right discharge ducts 60 and 62 connected to the cooling air guide channels 56 and 58 and vertically loaded in the side surface of the chilling chamber 8, the left and right discharge ducts 60 and 62 for discharging the cooling air from the side surface of the chilling chamber into the respective cells, and a cooling air suction path 64 formed in the lower portion of the mullion wall 10, the cooling air suction path 64 for sucking up the cooling air that completed the cooling operation while circulating in the chilling chamber 8 into the freezing cycle.

The discharge duct is horizontally loaded on the hind surface in the upper portion of the chilling chamber. A plurality of discharge openings 66 for discharging the cooling air into the upper portion of the chilling chamber 8 are formed in the front portion of the discharge duct 54.

The cooling air guide channels 56 and 58 consist of the first cooling air guide channel 56 connected to the discharge duct 54 and vertically formed on the hind wall of the chilling chamber 8 and a second guide channel 58 connected to the end of the first cooling air guide channel 56 and extending to the both sides of the chilling chamber 8.

The left and right discharge ducts 60 and 62 consist of the left discharge duct 60 vertically loaded on the left wall of the chilling chamber near the door 2 and the right discharge duct 62 vertically loaded on the right wall of the chilling chamber near the door 2.

The left discharge duct 60 and the right discharge duct 62 are rectangles vertically loaded on the left and right sides of the chilling chamber 8 to protrude by a predetermined width. Each one side of the left and right discharge ducts 60 and 62 is connected to the second cooling air guide channel 58 and receives the cooling air. A plurality of discharge openings 68 for discharging the cooling air to the respective cells are formed in the front portion of the left and right discharge ducts 60 and 62 to be separated from each other by a predetermined distance.

The left discharge duct 60 and the right discharge duct 62 are formed to protrude by the thickness of the door gasket 48 attached to the inside of the door 2. Accordingly, it is possible to prevent the cooling air from leaking out of an opening between the door gasket 48 and the side surface of the chilling chamber 8 when the door 2 is closed.

In the cooling air supplying device of the refrigerator according to the second embodiment, when the cooling air is supplied to the cooling air supply path 52 due to the rotation of the blast fan 20, the cooling air is discharged into the upper portion of the chilling chamber 8 through the discharge openings 66 of the discharge duct and is guided to the left and right sides of the chilling chamber 8 along the first and second cooling air guide channels 56 and 58.

The cooling air guided to the left side of the chilling chamber 8 is discharged from the left side of the chilling chamber 8 into the respective cells divided by the shelves through the plurality of discharge openings 68 formed in the left discharge duct 60. The cooling air guided to the right side of the chilling chamber 8 is discharged from the right side of the chilling chamber 8 into the respective cells through the plurality of discharge openings 68 formed in the right discharge duct 62.

Figure 9:
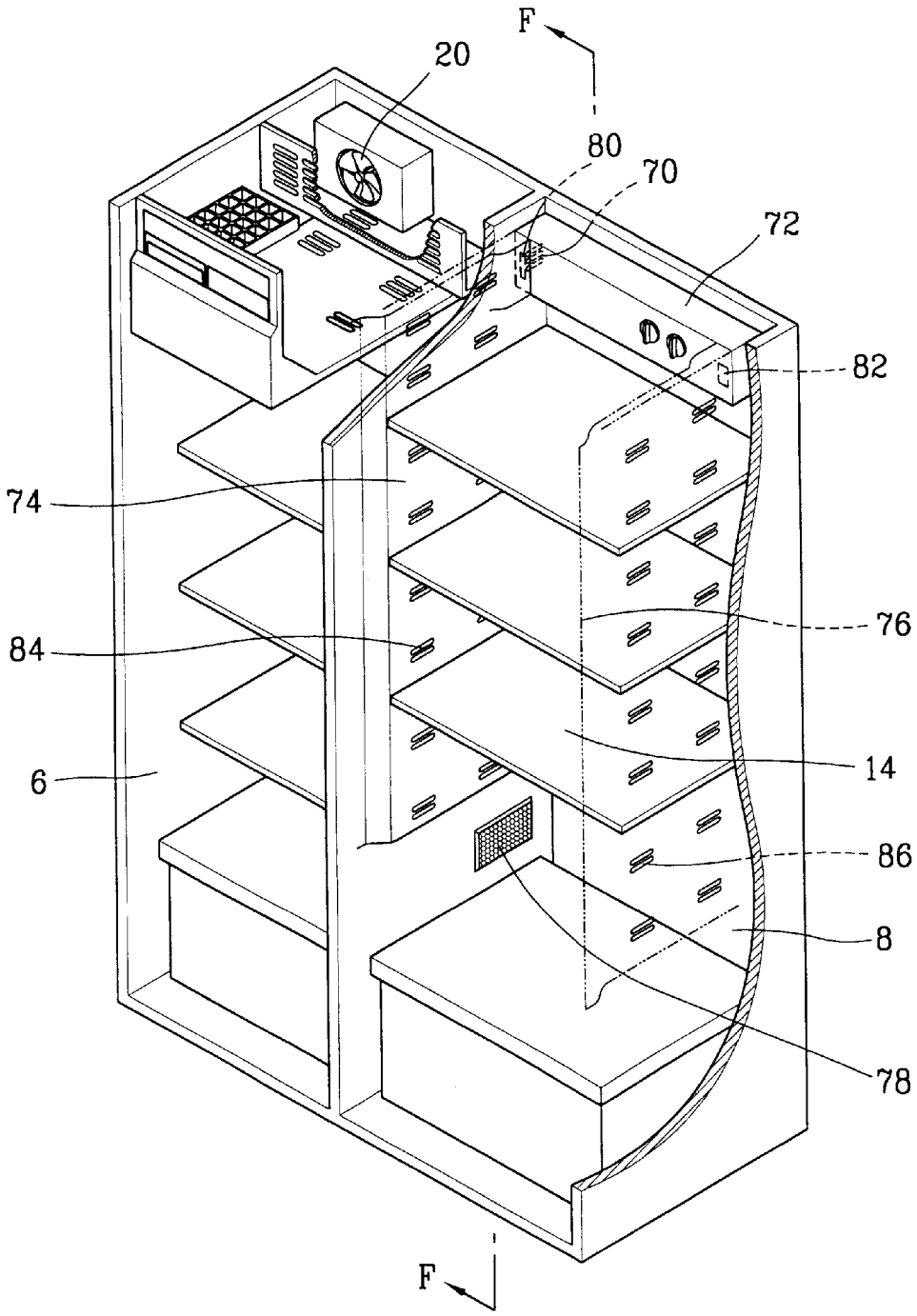
FIG. 9 is a perspective view showing a cooling air supplying device of a refrigerator according to a third embodiment of the present invention.
Figure 10:
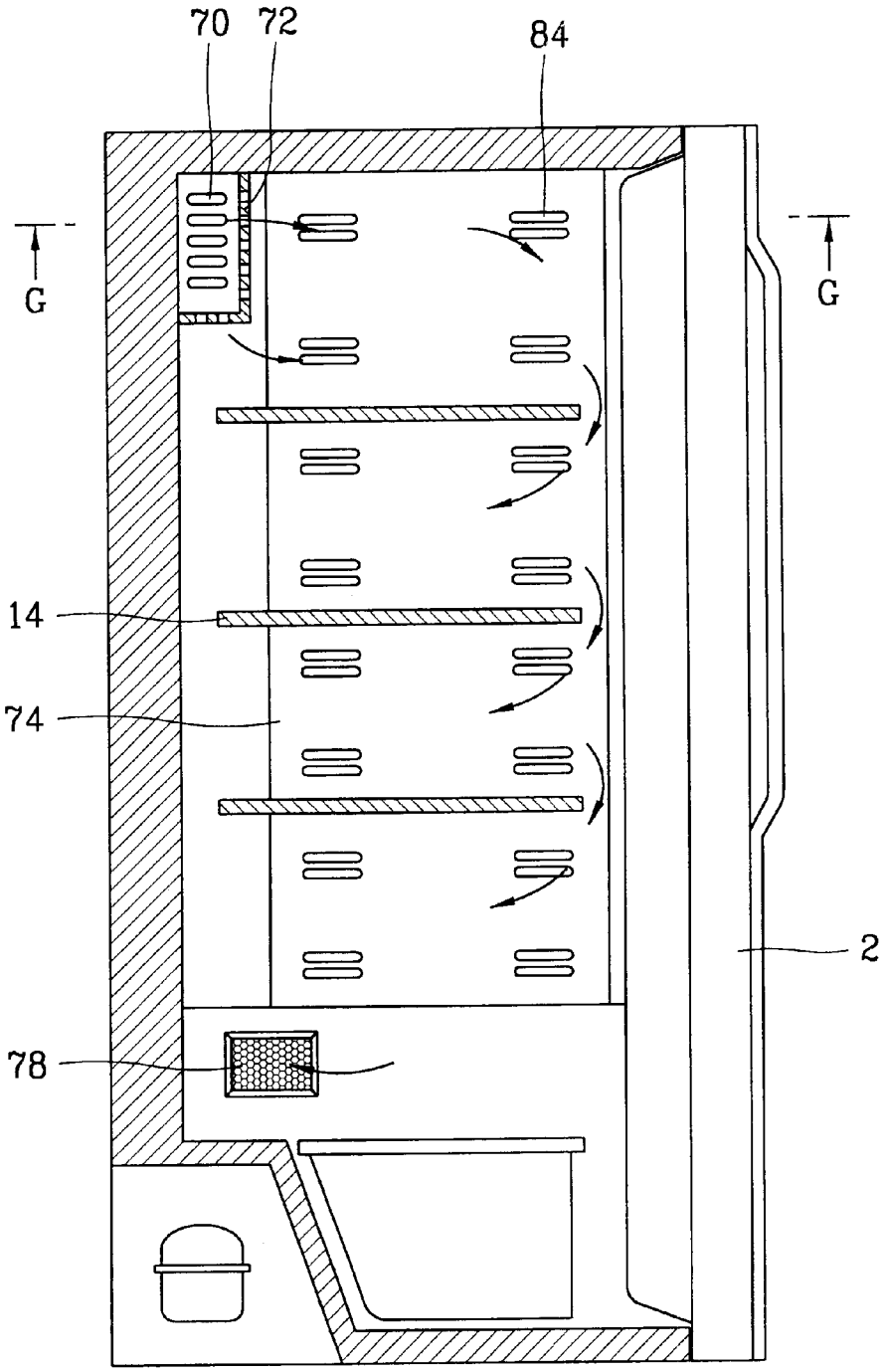
FIG. 10 is a sectional view taken along the line F—F of FIG. 9 showing the cooling air supplying device of the refrigerator according to the third embodiment of the present invention.
Figure 11:
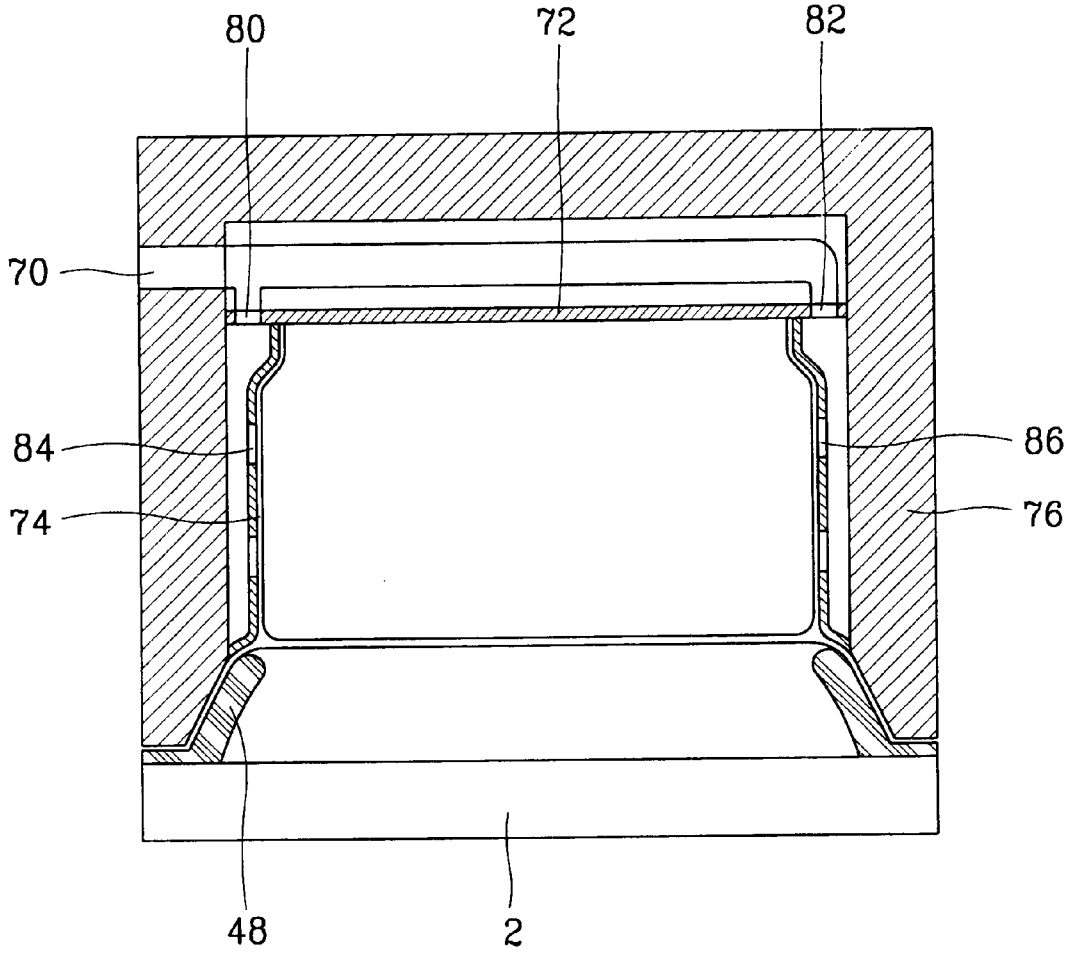
FIG. 11 is a sectional view taken along the line G—G of FIG. 10 showing the cooling air supplying device of the refrigerator according to the third embodiment of the present invention.

FIG. 9 is a perspective view showing a partially sectioned refrigerator according to a third embodiment of the present invention. FIG. 10 is a sectional view taken along the line F—F of FIG. 9 showing the chilling chamber cooling air supplying device according to the third embodiment of the present invention. FIG. 11 is a sectional view taken along the line G—G of FIG. 10 showing the chilling chamber cooling air supplying device according to the third embodiment of the present invention.

The chilling chamber cooling air supplying device according to the third embodiment includes a cooling air supply path 70 formed in the upper portion of the mullion wall 10 for separating the freezing chamber 6 from the chilling chamber 8, the cooling air supply path 70 for supplying the cooling air blown from the blast fan 20 installed in the freezing chamber 6 to the chilling chamber 8, a cooling air guide duct 72 connected to the cooling air supply path 70 and horizontally installed in the upper portion of the chilling chamber, the cooling air guide duct 72 for guiding the cooling air supplied to the cooling air supply path 70 to the side surface of the chilling chamber 8, and discharge ducts 74 and 76 connected to the cooling air guide duct 74 and loaded on the side surface of the chilling chamber 8, the discharge ducts 74 and 76 for discharging the cooling air supplied through the cooling air guide duct 72 from the side surface of the chilling chamber 8.

A cooling air suction path 78 for sucking up the cooling air that completed the cooling operation while circulating in the chilling chamber 8 into the freezing cycle is formed in the lower portion of the mullion wall 10.

The cooling air guide duct 72 is a rectangle, which is horizontally loaded on the hind wall in the upper portion of the chilling chamber 8 and in which a space, through which the cooling air passes, is provided. One side of the cooling air guide duct 72 contacts the mullion wall 10 and is connected to the cooling air supply path 70. A left guide path 80 for supplying the cooling air to the left side of the chilling chamber 8 is formed on the left side and in the front portion of the cooling air guide duct 72. A right guide path 82 for supplying the cooling air to the right side of the chilling chamber is formed on the right side and in the upper portion of the cooling air guide duct 72.

The discharge ducts 74 and 76 connected to the left guide path 80 consist of the first discharge duct 74 connected to the left guide path 80 and loaded on the left side of the chilling chamber and the second discharge duct 76 connected to the right guide path and loaded on the right side of the chilling chamber 8.

The first discharge duct 74 is attached to the left wall of the chilling chamber 8 and protrudes to the inside of the chilling chamber 8 so that a predetermined space is provided inside the first discharge duct 74. The upper portion of the first discharge duct 74 is connected to the left guide path 80 of the cooling air guide duct. A plurality of left discharge openings 84 for discharging the cooling air into the respective cells divided by the shelves 14 are formed in the front portion of the first discharge duct 74.

The second discharge duct 76 is attached to the right wall of the chilling chamber 8 and protrudes to the inside of the chilling chamber 8 so that a predetermined space is provided inside the second discharge duct 76. The upper portion of the second discharge duct 76 is connected to the right guide path 82. A plurality of right discharge openings 86 for discharging the cooling into the respective cells divided by the shelves 14 are formed in the front portion of the second discharge duct 76.

The first and second discharge ducts 74 and 76 are attached to the left and right walls of the chilling chamber 8 to occupy wide areas. Each one side surface of the first and second discharge ducts 74 and 76 is formed to tilt to a predetermined degree, to thus contact the door gasket 48 loaded in the door 2.

Since each one side surface of the first and second discharge ducts 74 and 76 contacts the door gasket 48, it is possible to prevent the cooling air discharged into the left and right discharge openings 84 and 86 from leaking out of the opening between the door gasket 48 and the chilling chamber 8 when the door 2 is closed.

The left and right discharge openings 84 and 86 are vertically formed in the front portions of the first and second discharge ducts 74 and 76 to be separated from each other by a predetermined distance and are preferably formed in two rows so as to discharge more cooling air.

In the chilling chamber cooling air supplying device according to the third embodiment, when the cooling air is supplied to the cooling air supply path 70 due to the rotation of the blast fan 20, the cooling air is supplied to the cooling air guide duct 72. The cooling air sucked up into the cooling air guide duct 72 is supplied to the first discharge duct 74 through the left guide path 80 and to the second discharge duct 76 through the right guide path 82.

The cooling air supplied to the first discharge duct 74 is discharged into is the respective cells divided by the shelves 14 on the left side of the chilling chamber 8 through the plurality of left discharge openings 84 formed in the first discharge duct 74. The cooling air supplied to the second discharge duct 76 is discharged into the respective cells divided by the shelves 14 on the right side of the chilling chamber 8 through the plurality of right discharge openings 86 formed in the second discharge duct 76.

At this time, since the left and right discharge openings 84 and 86 are arranged in two rows by cells, a large amount of cooling air is discharged. Accordingly, the chilling chamber is rapidly and impartially cooled.

Figure 12:
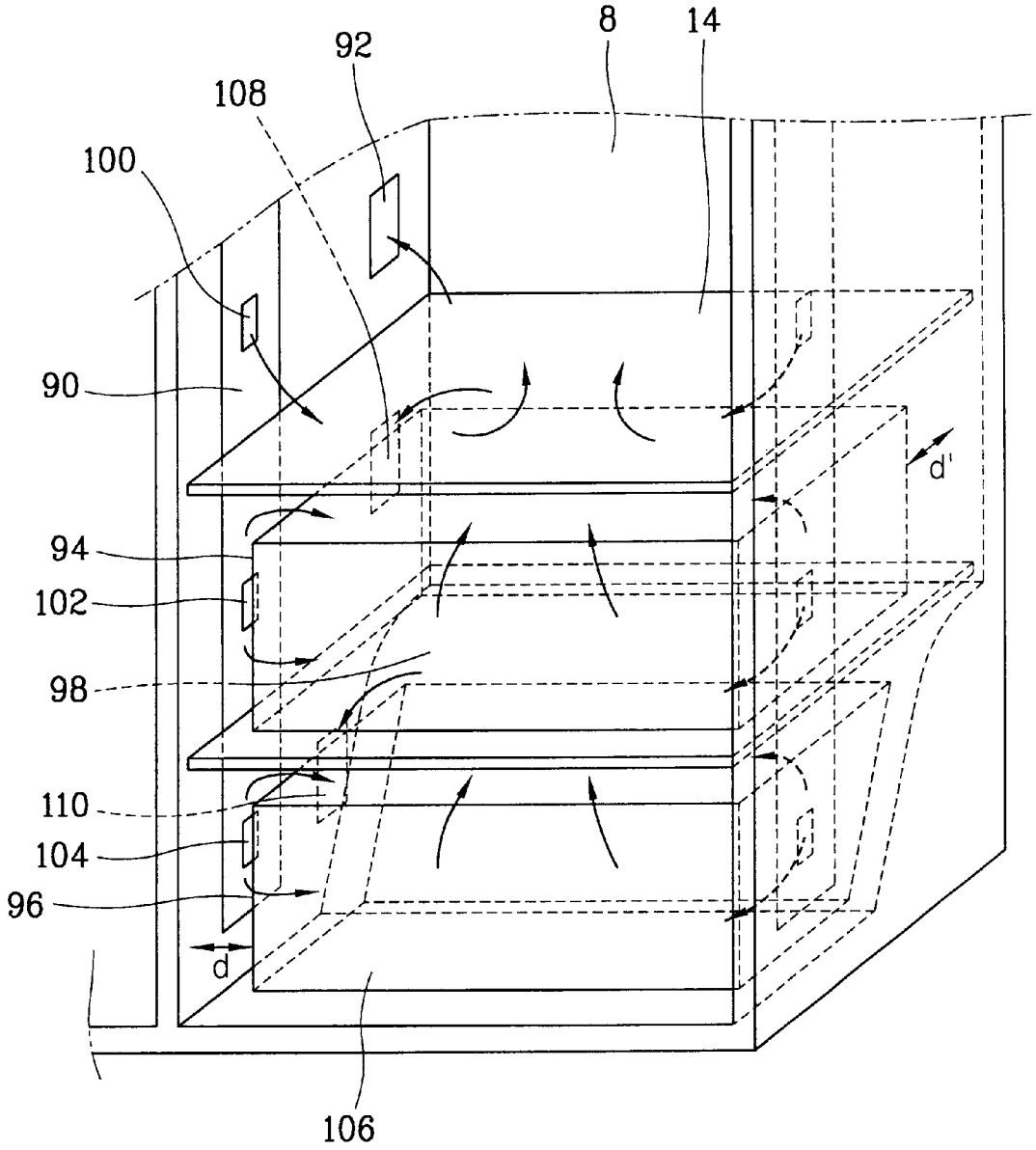
FIG. 12 is a perspective view showing a partially sectioned cooling air supplying device of a refrigerator according to a fourth embodiment of the present invention.

FIG. 12 is a partial perspective view showing a chilling chamber cooling air supplying device according to a fourth embodiment of the present invention.

In the chilling chamber cooling air :supplying device according to the fourth embodiment, cooling air discharge ducts 90 are vertically formed on the both walls of the chilling chamber 8 near apertures, in which the door is loaded. Cooling air suction paths 92 are vertically formed inside the both walls of the chilling chamber 8.

The plurality of shelves 14 for holding the cold food are installed in the chilling chamber 8 to be separated from each other by a predetermined distance. Vegetables 98 and 106, in which vegetable storage boxes 94 and 96 are bedded, in the lower portion of the chilling chamber 8.

The cooling air discharge ducts 90 are vertically formed on the both side surfaces so that the cooling air is discharged from the both side surfaces of the chilling chamber 8. A plurality of discharge openings 100 for discharging the cooling air into the respective cells divided by the shelves 14 are formed in the front portion of the cooling air discharge ducts 90 to be separated from each other by a predetermined distance. The lower ends of the cooling air discharge ducts 90 extend to the vegetable chambers 98 and 106 of the chilling chamber 8, to thus discharge the cooling air into the vegetable chambers 98 and 106.

Discharge openings 102 and 104 for discharging the cooling air into the vegetable chamber 98 are formed in the portion extending to the vegetable chamber 98 of the cooling air discharge ducts 90. In particular, when the vegetable chamber 98 is divided by the shelves 14, thus the two vegetable storage boxes 94 and 96 are bedded, the first cooling air discharge opening 102 for discharging the cooling air into the first vegetable chamber 98 and the second cooling air discharge opening 104 for discharging the cooling air into the second vegetable chamber 106 are respectively formed.

The vegetable storage boxes 94 and 96 are loaded in the chilling chamber 8 to be separated from the both side walls of the chilling chamber 8 by a predetermined distance d and to be separated from the hind portion of the chilling chamber 8 by a predetermined distance d' so that the cooling air discharged through the first and second cooling air discharge openings 102 and 104 smoothly circulates around the vegetable storage boxes 94 and 96.

The cooling air that is discharged through the cooling air discharge openings 100, 102, and 104 and completed the cooling operation while circulating the chilling chamber 8 is sucked up into the cooling cycle through the cooling air suction paths 92 formed on the both side walls of the chilling chamber 8 to be separated from each other by a predetermined distance.

The cooling air suction paths 92 are formed in the respective cells divided by the shelves 14.

A first cooling air suction path 108, into which the cooling air that is discharged from the first cooling air discharge opening 102 and cooled the first vegetable chamber 98 is sucked up, is formed behind the first cooling air discharge opening 102. A second cooling air suction path 110, into which the cooling air that is discharged from the second cooling air discharge opening 104 and cooled the second vegetable chamber 104 is sucked up, is formed hind the second cooling air discharge opening 104.

In the chilling chamber cooling air supplying device according to the fourth embodiment having the above structure, when the cooling air is supplied to the cooling air discharge ducts 90, the cooling air is discharged into the chilling chamber 8 through the plurality of cooling air discharge openings 100 formed in the front portion of the cooling air discharge ducts 90 and performs the cooling operation. The cooling air that completed the cooling operation while circulating the chilling chamber 8 is sucked up into the cooling cycle through the cooling air suction paths 92.

At this time, the cooling air discharged through the first cooling air discharge opening 102 cools the first vegetable chamber 98 while circulating the first vegetable chamber 98 and is sucked up into the first cooling air suction path 108. The cooling air discharged into the second cooling air discharge opening 104 cols the second vegetable chamber 106 while circulating the second vegetable chamber 106 and is sucked up into the second cooling air suction path 110.

In the cooling air supplying device according to the fourth embodiment, the cooling air is discharged through additional cooling air discharge openings in the vegetable chamber of the chilling chamber 8, to thus cool the vegetable chamber.

Figure 13:
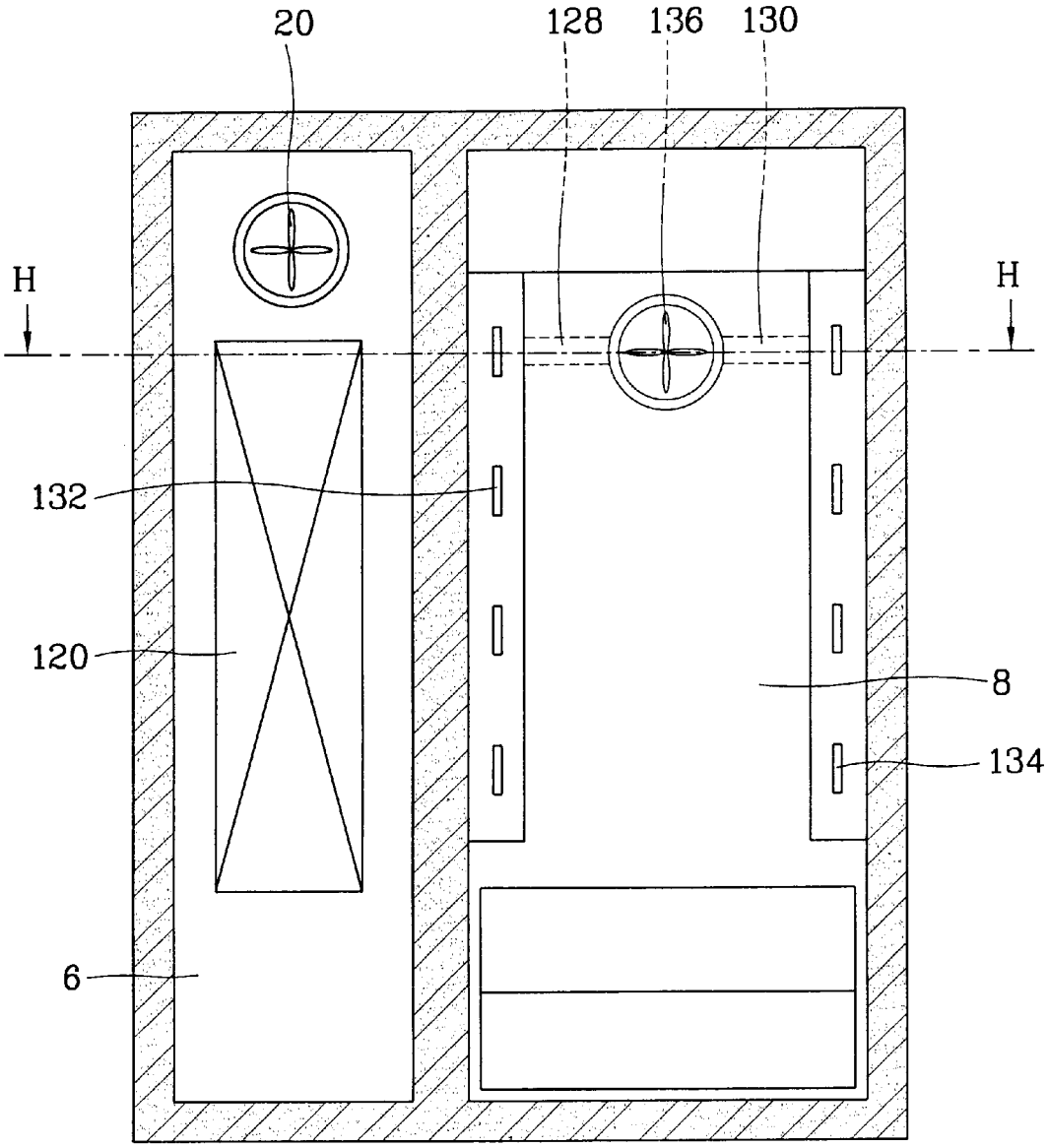
FIG. 13 is a front view showing a cooling air supplying device of a refrigerator according to a fifth embodiment of the present invention.
Figure 14:
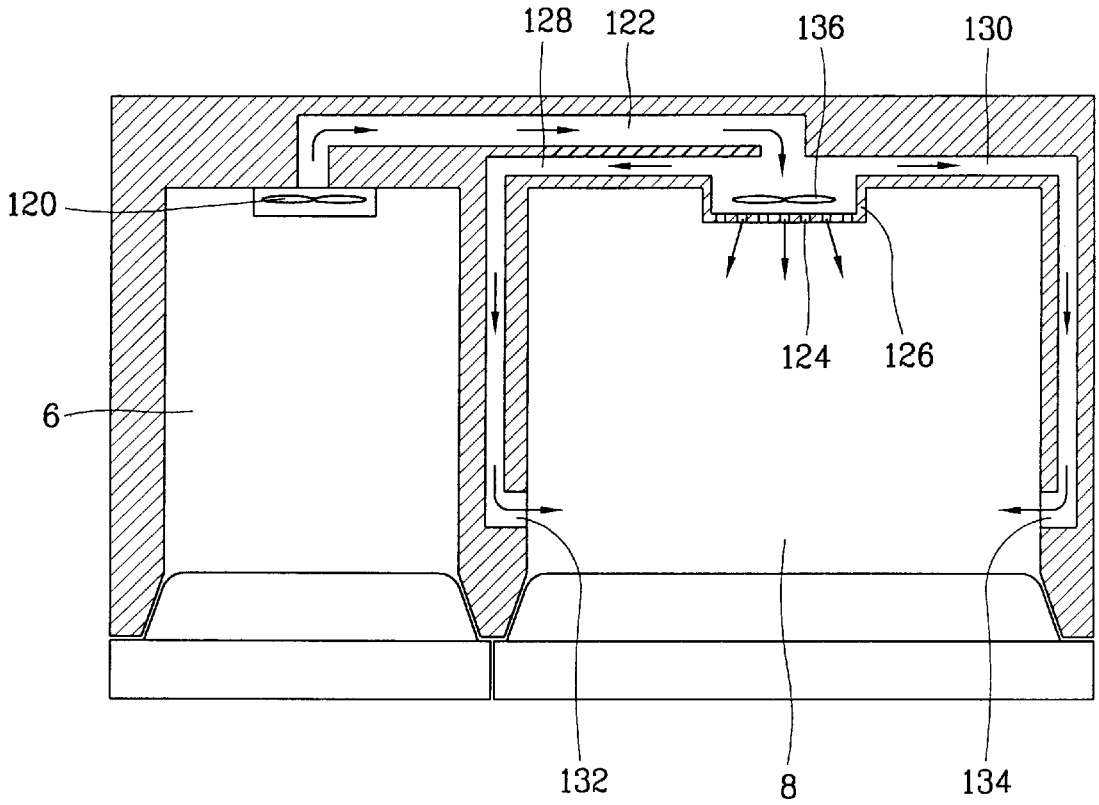
FIG. 14 is a sectional view taken along the line H—H of FIG. 13 showing the cooling air supplying device of the refrigerator according to the fifth embodiment of the present invention.

FIG. 13 is a side view showing a chilling chamber cooling air supplying device according to a fifth embodiment of the present invention. FIG. 14 is a side view showing a chilling chamber cooling air supplying device according to the fifth embodiment of the present invention.

The chilling chamber cooling air supplying device according to the fifth embodiment includes the blast fan 20 installed in the freezing chamber 6, the blast fan 20 for forcibly circulating the air cooled while passing through a heat exchanger 120 of the cooling cycle, a cooling air supply path 122 for supplying the cooling air blown from the blast fan 20 to the chilling chamber 8, a discharge duct 126 formed in the upper and hind portion of the chilling chamber 8, connected to the cooling air supplying path 122, and having a plurality of cooling air discharge openings 124 in the front portion of the discharge duct 126 so that the cooling air supplied to the cooling air supply path 122 is discharged into the upper portion of the chilling chamber 8, left and right guide channels 128 and 130 connected to the left and right sides of the cooling air discharge duct 126, the left and right guide channels 128 and 130 for guiding the cooling air supplied to the cooling air discharge duct 126 to the left and right sides of the chilling chamber 8, a left cooling air discharge opening 132 connected to the left guide channel 128, the left cooling air discharge opening 132 for discharging the cooling air from the left side of the chilling chamber 8, a right cooling air discharge opening 134 connected to the right guide channel 130, the right cooling air discharge opening 134 for discharging the cooling air from the right side of the chilling chamber 8, and a pressure fan 136 installed inside the discharge duct 126, the pressure fan 136 for providing blast power so as to increase the pressure of the discharged cooling air when the cooling air is discharged into the cooling air discharge openings 124, 132, and 134.

The pressure fan 136 provides blast pressure to the cooling air supplied to the discharge duct 126, to thus increase the amount of the cooling air supplied to the chilling chamber 8 through the cooling air discharge opening and to thus rapidly cool the chilling chamber.

The effect of the cooling air supplying device of the refrigerator according to the present invention having the above structure and operation will now be described.

The cooling air discharge ducts having the discharge openings for discharging the cooling air into the respective cells divided by the shelves are vertically formed on the both side walls of the chilling chamber. Accordingly, it is possible to discharge the cooling air from the both side walls of the chilling chamber into the respective cells, to thus impartially supply the cooling air to the chilling chamber. Therefore, it is possible to uniformly maintain the spread of temperature of the chilling chamber.

Also, the discharge ducts are formed on the both side walls of the chilling chamber near the door. Accordingly, it is possible to let the cooling air discharged near the door, to thus prevent a rise in temperature of the chilling chamber, which is caused by frequently closing and opening the door and to thus a drop in temperature of the food stored near the door.

Also, the discharge ducts are formed to protrude by a predetermined width from the both side surfaces of the chilling chamber. Accordingly, it is possible to prevent the cooling air leaking out of the opening between the chilling chamber and the door gasket.

Also, the discharge ducts are formed to extend to the vegetable chambers, in which the vegetable boxes are bedded. Accordingly, it is possible to discharge the cooling air into the vegetable chambers, to thus smoothly cool the vegetable chambers.

Also, the blast pressure is provided to the cooling air discharged into the chilling chamber by installing the pressure fan on the channel for supplying the cooling air to the chilling chamber.

What is claimed is:

1. A cooling air supplying device of a refrigerator, comprising:

a cooling air supply path formed in the upper portion of a mullion wall for separating a freezing chamber from a chilling chamber, the cooling air supply path for supplying cooling air blown from a blast fan arranged in the freezing chamber to the chilling chamber;

a discharge duct connected to the cooling air supply path and installed in the upper portion of the chilling chamber, the discharge duct for discharging the cooling air from the upper portion of the chilling chamber;

cooling air guide channels connected to the discharge duct, the cooling air guide channels for guiding the cooling air to one side or both sides of the chilling chamber; and cooling air discharge units connected to the cooling air guide channels and formed on one side surface or the both side surfaces of a main frame, the cooling air discharge units for discharging the cooling air from the side surface of the chilling chamber into the respective cells divided by shelves.

2. The cooling air supplying device of claim 1, wherein the discharge duct is horizontally attached to the hind wall in the upper portion of the chilling chamber and has a plurality of discharge openings for discharging the cooling air into the upper portion of the chilling chamber in the front portion.

3. The cooling air supplying device of claim 1, wherein the cooling air guide channels comprise a first cooling air guide channel connected to the lower portion of the discharge duct and vertically formed in the hind portion of the chilling chamber and a second cooling air guide channels formed to extend from the first cooling air guide channel to the both side walls of the chilling chamber.

4. The cooling air supplying device of claim 3, wherein the second cooling air guide channels are formed to extend from the first cooling air guide channel to the respective cells to be separated from each other by a predetermined distance, to thus guide the cooling air to the respective cells divided by the shelves of the chilling chamber.

5. The cooling air supplying device of claim 1, wherein the cooling air discharge units comprise left discharge ducts connected to the guide channels extending to the left side among the second cooling air guide channels, the left discharge ducts for discharging the cooling air from the left side of the chilling chamber and right discharge ducts connected to the guide channels extending to the right side among the second cooling air guide channels, the right discharge ducts for discharging the cooling air from the right side of the chilling chamber.

6. The cooling air supplying device of claim 5, wherein the left and right discharge ducts are formed in the respective cells on the left and right sides of the chilling chamber and cooling air discharge openings for discharging the cooling air are formed in the front portion of the left and right discharge ducts to protrude by a predetermined width to the inside of the chilling chamber on the left and right sides of the chilling chamber.

7. The cooling air supplying device of claim 5, wherein the left and right discharge ducts are formed on the both side walls near the door of the refrigerator.

8. The cooling air supplying device of claim 5, wherein the left and right discharge ducts are formed to protrude above the portion where a door gasket attached to the door of the chilling chamber contacts the opened surface of the chilling chamber by a predetermined width.

9. The cooling air supplying device of claim 1, wherein the cooling air discharge units comprise the cooling air discharge ducts connected to the cooling air guide channels extending to the side direction of the chilling chamber and vertically loaded on the side surface of the chilling chamber and the plurality of cooling air discharge openings formed in the front portion of the cooling air discharge ducts to be separated from each other by a predetermined distance, the cooling air discharge openings for discharging the cooling air into the respective cells divided by the shelves.

10. The cooling air supplying device of claim 9, wherein the cooling air discharge ducts comprise a left discharge duct connected to the cooling air guide channels extending to the left side of the chilling chamber and vertically installed on the left side surface of the chilling chamber near the door and a right discharge duct connected to the cooling air guide channels extending to the right side of the chilling chamber and vertically installed on the right side surface of the chilling chamber near the door.

11. The cooling air supplying device of claim 9, wherein each one side of the cooling air discharge ducts is formed to protrude by a predetermined width to the inside of the chilling chamber so that each one side of the cooling air discharge ducts contacts the door gasket attached to the door for opening and closing the chilling chamber.

12. A cooling air supplying device of a refrigerator, comprising:

a cooling air supply path formed in the upper portion of a mullion wall for separating a freezing chamber from a chilling chamber, the cooling air supply path for supplying cooling air blown from a blast fan installed in the freezing chamber to the chilling chamber;

a cooling air guide duct connected to the cooling air supply path and installed in the upper portion of the chilling chamber, the cooling air guide duct for guiding the cooling air supplied to the cooling air supply path to one side wall or both side walls of the left and right side walls of the chilling chamber; and discharge ducts connected to the cooling air guide duct and loaded on one surface or the both surfaces of the left and right sides of the chilling chamber, the discharge ducts for discharging the cooling air guided by the cooling air guide duct into the respective cells of the chilling chamber.

13. The cooling air supplying device of claim 12, wherein the cooling air guide duct is horizontally loaded on the hind wall in the upper portion of the chilling chamber, one side of the cooling air guide duct is connected to the cooling air supply path, and left and right guide paths for supplying the cooling air to the left and right sides of the chilling chamber are formed on the left and right sides in the front portion.

14. The cooling air supplying device of claim 12, wherein the discharge ducts comprise a left discharge duct connected to the left guide path of the cooling air guide duct, formed on the left side wall of the chilling chamber to protrude to the inside of the chilling chamber, and having a plurality of left discharge openings for discharging the cooling air into the respective cells divided by the shelves in the front portion and a right discharge duct connected to the right guide path of the cooling air guide duct, formed on the right side wall of the chilling chamber to protrude to the inside of the chilling chamber, having a plurality of right discharge openings for discharging the cooling air into the respective cells divided by the shelves in the front portion.

15. The cooling air supplying device of claim 14, wherein the left and right discharge ducts are attached on the left and right side walls of the chilling chamber to occupy wide areas and each one side surface tilts to have a predetermined tilt angle so as to contact the door gasket loaded in the door.

16. The cooling air supplying device of claim 14, wherein the left and right discharge openings are formed in the front portion of the left and right discharge ducts to be separated from each other by a predetermined distance so that the cooling air is discharged into the respective cells divided by the shelves and are horizontally arranged in two row.

17. A cooling air supplying device of a refrigerator, comprising:

a cooling air supply path formed in the upper portion of a mullion wall for separating a freezing chamber from a chilling chamber, the cooling air supply path for supplying cooling air blown from a blast fan installed in the freezing chamber to the chilling chamber;

a cooling air guide duct connected to cooling air supply path and installed in the upper portion of the chilling chamber, the cooling air guide duct for guiding the cooling air supplied to the cooling air supply path to one side wall or both side walls of the left and right side walls of the chilling chamber; and a cooling air discharge duct connected to the cooling air guide duct and loaded on one side surface or on the both side surfaces of the left and right sides of the chilling chamber, the cooling air discharge duct for discharging the cooling air from the side surface of the chilling chamber into the respective cells and discharging the cooling air into the vegetable chambers, in which vegetable boxes are bedded.

18. The cooling air supplying device of claim 17, wherein the cooling air discharge duct is formed near the door so that the cooling air is discharged from the door into the chamber, a plurality of discharge openings for discharging the cooling air into the respective cells divided by the shelves are formed in the front portion to be separated from each other by a predetermined distance, and the cooling air discharge duct is formed to extend to the vegetable chambers of the chilling chamber so as to discharge the cooling air into the vegetable chambers.

19. The cooling air supplying device of claim 18, wherein cooling air discharge openings for discharging the cooling air into the vegetable chambers are formed in the portion extended to the vegetable chambers of the cooling air discharge duct.

20. The cooling air supplying device of claim 17, wherein the vegetable storage boxes are bedded in the vegetable chambers to be separated from the both side walls and the hind wall of the chilling chamber by predetermined distances so that the cooling air discharged through the discharge openings can smoothly circulate around the vegetable storage boxes.

21. A cooling air supplying device of a refrigerator, comprising:

a cooling air supply path formed in the upper portion of a mullion wall for separating a freezing chamber from a chilling chamber, the cooling air supply path for supplying cooling air blown from a blast fan installed in the freezing chamber to the chilling chamber;

a discharge duct (34) connected to the cooling air supply path (32) and installed in the upper portion of the chilling chamber, the discharge duct for discharging the cooling air from the chilling chamber;

cooling air guide channels connected to the discharge duct (34) the cooling air guide channels for guiding the cooling air to one side surface or both side surfaces of the chilling chamber;

cooling air discharge units connected to the cooling air guide channels and formed one surface or both surfaces of a main frame, the cooling air discharge units for discharging the cooling air into the respective cells divided by the shelves on the side surface of the chilling chamber; and a pressure fan installed in the discharge duct, the pressure fan for providing blast pressure to the cooling air discharged into the chilling chamber.

* * * * *